US010403097B2

(12) United States Patent
Nakamura

(10) Patent No.: US 10,403,097 B2
(45) Date of Patent: Sep. 3, 2019

(54) GAMING MACHINE, METHOD FOR PROVIDING A GAME, AND A PROGRAM

(71) Applicant: Konami Gaming, Inc., Las Vegas, NV (US)

(72) Inventor: Daisuke Nakamura, Zama (JP)

(73) Assignee: KONAMI GAMING, INC., Las Vegas, NV (US)

( * ) Notice: Subject to any disclaimer, the term of this patent is extended or adjusted under 35 U.S.C. 154(b) by 0 days.

(21) Appl. No.: 14/850,493

(22) Filed: Sep. 10, 2015

(65) Prior Publication Data

US 2016/0086427 A1 Mar. 24, 2016

(30) Foreign Application Priority Data

Sep. 24, 2014 (JP) ..... 2014-193810

(51) Int. Cl.
*G07F 17/34* (2006.01)
*G07F 17/32* (2006.01)

(52) U.S. Cl.
CPC ..... *G07F 17/34* (2013.01); *G07F 17/326* (2013.01)

(58) Field of Classification Search
CPC ..... G07F 17/34; G07F 17/326
See application file for complete search history.

(56) References Cited

U.S. PATENT DOCUMENTS 4,448,419 A * 5/1984 Telnaes ..... G07F 17/3244 273/143 R
4,711,451 A * 12/1987 Pajak ..... G07F 17/3244 273/143 R
4,858,932 A * 8/1989 Keane ..... G07F 17/3244 463/21
5,085,436 A * 2/1992 Bennett ..... G07F 17/3244 273/143 R
5,154,421 A * 10/1992 Hamano ..... G07F 17/3244 273/143 R
5,423,541 A * 6/1995 Nicastro ..... G07F 17/3244 273/143 R (Continued)

FOREIGN PATENT DOCUMENTS

AU 2014201668 B2 4/2014
EP 1383093 A2 1/2004

OTHER PUBLICATIONS

Australian Patent Examination Report No. 1 dated Nov. 6, 2015 for Australian Patent Application No. 2015227387.

*Primary Examiner* — David L Lewis
*Assistant Examiner* — Matthew D Hoel
(74) *Attorney, Agent, or Firm* — Howard & Howard Attorneys PLLC

(57) ABSTRACT

To provide a gaming machine that can provide a novel game in which the game progression is varied, a method, and a program for providing a game. In the gaming machine 1, the symbol blocks B1 and B2 displayed in the block display region 66 move in the directions D1 and D2, which intersect in the direction of reel rotation, when moving in the symbol display region 60. That is, the symbol blocks B1 and B2 are added to the movement in the direction of reel rotation, and also move in a direction orthogonal to the direction of reel rotation. Therefore, compared to a case in which a symbol block moves in the direction of reel rotation, prediction by a player of the positions where the symbol blocks B1 and B2 are finally disposed is difficult.

31 Claims, 13 Drawing Sheets

(56) References Cited

U.S. PATENT DOCUMENTS 5,725,428 A * 3/1998 Achmuller ..... G07F 17/34 273/143 R
5,873,781 A * 2/1999 Keane ..... G07C 15/006 463/22
5,984,781 A * 11/1999 Sunaga ..... G07F 17/3244 463/16
6,159,096 A * 12/2000 Yoseloff ..... G07F 17/3244 273/138.1
6,251,013 B1 * 6/2001 Bennett ..... G07F 17/3211 273/143 R
6,419,583 B1 * 7/2002 Crumby ..... G07F 17/32 273/138.1
6,471,208 B2 * 10/2002 Yoseloff ..... G07F 17/32 273/143 R
6,612,927 B1 * 9/2003 Slomiany ..... G07F 17/3244 463/13
6,644,664 B2 * 11/2003 Muir ..... G07F 17/34 273/138.1
7,371,170 B2 * 5/2008 Cregan ..... G07F 17/3265 273/138.1
7,578,735 B2 * 8/2009 Frizzell ..... G07F 17/3265 273/138.1
7,578,737 B2 * 8/2009 Cregan ..... G07F 17/3265 273/138.1
7,578,738 B2 * 8/2009 Cregan ..... G07F 17/3265 273/138.1
7,594,851 B2 * 9/2009 Falconer ..... G07F 17/34 463/16
7,824,262 B2 * 11/2010 Webb ..... G07F 17/32 463/10
8,012,011 B2 * 9/2011 Baerlocher ..... G07F 17/3213 463/20
8,162,741 B2 * 4/2012 Wadleigh ..... G07F 17/34 463/16
8,382,577 B2 2/2013 Teranishi et al.
9,087,434 B2 * 7/2015 Schwerdling ..... G07F 17/3267
9,153,091 B2 * 10/2015 Berman ..... G07F 17/32
9,196,131 B2 * 11/2015 Meyer ..... G07F 17/326
9,208,651 B2 * 12/2015 Jaffe ..... G07F 17/3288
9,495,839 B2 * 11/2016 Aoki ..... G07F 17/326
2001/0016513 A1 * 8/2001 Muir ..... G07F 17/34 463/16
2001/0048193 A1 * 12/2001 Yoseloff ..... G07F 17/32 273/138.1
2002/0025846 A1 * 2/2002 Bennett ..... G07F 17/3244 463/20
2002/0132660 A1 * 9/2002 Taylor ..... G07F 17/32 463/16
2003/0064781 A1 * 4/2003 Muir ..... G07F 17/3211 463/20
2003/0085514 A1 * 5/2003 Yoseloff ..... G07F 17/32 273/143 R
2003/0203752 A1 * 10/2003 Kaminkow ..... G07F 17/32 463/20
2003/0207707 A1 * 11/2003 Slomiany ..... G07F 17/3244 463/16
2004/0132527 A1 * 7/2004 Berman ..... G07F 17/3211 463/18
2005/0101379 A1 * 5/2005 Falconer ..... G07F 17/34 463/25
2006/0058097 A1 3/2006 Berman et al.
2007/0105611 A1 * 5/2007 O'Halloran ..... G07F 17/3244 463/16
2007/0178965 A1 * 8/2007 Inoue ..... G07F 17/3211 463/30
2009/0124325 A1 * 5/2009 Wadleigh ..... G07F 17/3267 463/20
2010/0190544 A1 * 7/2010 Thomas ..... G07F 17/34 463/20
2012/0149455 A1 * 6/2012 Sasaki ..... G07F 17/32 463/17
2012/0178517 A1 7/2012 Montenegro et al.
2013/0331173 A1 * 12/2013 Jaffe ..... G07F 17/3267 463/21
2014/0080571 A1 * 3/2014 Garretsen ..... G07F 17/3218 463/20
2014/0228091 A1 * 8/2014 Berman ..... G07F 17/34 463/20
2016/0125687 A1 * 5/2016 Berman ..... G07F 17/34 463/21
2016/0364945 A1 * 12/2016 Zoltewicz ..... G07F 17/326

* cited by examiner

70

| 71 | 72 | 73 | 74 | 75 |
|---|---|---|---|---|
| PicC | K | 9 | PicB | PicA |
| Q | PicA | J | Scatter | 10 |
| Wild | Q | PicB | A | K |
| 9 | Wild | PicE | PicD | 9 |
| PicD | | PicA | Wild | A |
| PicC | | PicA | | A |
| PicB | J | PicA | | A |
| 10 | PicC | K | 10 | Q |
| K | PicD | 10 | PicB | Scatter |
| PicA | A | Q | K | 9 |
| Wild | PicE | Wild | PicC | Wild |
| J | 9 | | Q | PicA |
| PicA | PicA | | A | PicA |
| 9 | PicA | PicA | 9 | PicD |
| PicA | PicA | A | PicA | J |
| PicA | K | K | PicE | PicE |
| 10 | PicB | PicC | J | K |
| Scatter | 10 | PicD | PicC | Wild |
| Wild | Scatter | 10 | K | PicC |

60

FIG. 4

| | | | |
|---|---|---|---|
| 3x | Wild | Wild | Wild |
| 3x | Wild | Wild | Wild |
| | Wild | Wild | Wild |

FIG. 13

GAMING MACHINE, METHOD FOR PROVIDING A GAME, AND A PROGRAM

CROSS-REFERENCE TO RELATED APPLICATION

This application claims priority to Japanese Patent Application Serial No. 2014-193810, filed Sep. 24, 2014, the disclosure of which is hereby incorporated by reference in its entirety.

TECHNICAL FIELD

The present invention relates to a gaming machine, method for providing a game, and a program.

BACKGROUND ART

A gaming machine represented by a slot machine is highly popular among casino customers as a device that provides gambling that is easy to enjoy, and recent statistics also report that sales from gaming machines account for the majority of casino earnings. Initial slot machines were simple devices, wherein an inserted coin is received, a configured reel rotates and stops mechanically according to a handle operation, and win or lose is determined by a combination of symbols stopped on a single pay line. However, recent gaming machines, such as mechanical slot machines driven by a highly accurate physical reel via a computer controlled stepping motor, video slot machines that display a virtual reel on a display connected to a computer, and various gaming machines that apply similar technology to other casino games are quickly advancing. For the manufacturers that develop these gaming machines, an important theme is to provide an attractive game that strongly attracts casino customers as players, and improves the functionality of the gaming machine.

In consideration of this type of background, a symbol replacement process is proposed for recent gaming machines to provide change in the staging until the final game result is displayed by, after a symbol sequence is formed by temporarily stopping a reel, replacing a portion of the symbols configuring a symbol sequence with different symbols (for example, see Patent Document 1 described below). According to the symbol replacement process, even after a reel stops, a player can continue expecting to win, and interest in the game results by a player can continue for long time.

DOCUMENTS OF THE RELATED ART

Patent Document #1: U.S. Pat. No. 8,382,577.

SUMMARY OF THE INVENTION

However, even for a game machine where the symbol replacement process described above is employed, maintaining the interest of a player in a game is difficult when the symbol replacement results can be easily predicted because the final game results can be predicted. Therefore, a symbol replacement process has been anticipated in which the prediction of symbol replacement results is more difficult and that realizes a variety in game progression.

Various aspects of the present invention have been made in light of the above circumstances, and an object is to provide a gaming machine that can provide a novel game in which the game progression is varied, a method for providing a game, and a program.

In order to resolve the problems described above, a gaming machine according to one aspect of the present invention includes an operation unit that accepts operation by a player; a display unit having a first region that partially displays a plurality of reels each having a series of symbols and a second region that aligns with the first region in the rotational direction of the reels; and a control unit connected to the operation unit and the display unit that rotates and stops the plurality of reels according to the operation of the operation unit by a player, and grants an award for a symbol sequence formed in the first region of the display unit by a stopped plurality of the reels; wherein the control unit displays at least one symbol block configured of one or a plurality of symbols in the second region of the display unit when a predetermined game condition is satisfied, moves the symbol block displayed in the second region toward the first region in a direction that intersects the rotational direction of the reels and disposes the symbol block in a position overlapping with a symbol sequence formed in the first region of the display unit, superimposes and displays a symbol for the symbol block in a position where the symbol block overlaps the symbol sequence, and grants an award for a symbol sequence in the first region of the display unit for which the symbol in the symbol block is superimposed and displayed.

Further, the control method of the game according to one aspect of the present invention is a method for providing a game in a gaming machine comprising an operation unit that accepts operation by a player, a display unit having a first region that partially displays a plurality of reels each having a series of symbols and a second region that aligns with the first region in the rotational direction of the reels, and a control unit connected to the operation unit and the display unit that rotates and stops the plurality of reels according to the operation of the operation unit by a player, and grants an award for a symbol sequence formed in the first region of the display unit by a stopped plurality of the reels; wherein the control unit executes: a step for rotating the plurality of reels according to the operation of the operation unit by a player; a step for stopping the rotation of the plurality of reels and forming a symbol sequence in the first region of the display unit; a step for displaying at least one symbol block configured of one or a plurality of symbols in the second region of the display unit when a predetermined game condition is satisfied; a step for moving the symbol block displayed in the second region toward the first region in a direction that intersects the rotational direction of the reels and disposing the symbol block in a position overlapping with a symbol sequence formed in the first region of the display unit; a step for superimposing and displaying a symbol for the symbol block in a position where the symbol block overlaps the symbol sequence; and a step for granting an award for a symbol sequence in the first region of the display unit for which the symbol in the symbol block is superimposed and displayed.

Further, a program according to one aspect of the present invention is a program executed by an operation unit that accepts operation by a player, a display unit having a first region that partially displays a plurality of reels each having a series of symbols and a second region that aligns with the first region in the rotational direction of the reels, and a computer connected to the operation unit and the display unit that rotates and stops the plurality of reels according to the operation of the operation unit by a player, and grants an award for a combination of symbols formed in the first region of the display unit by a stopped plurality of the reels; wherein the program realizes in the computer: a function for rotating the plurality of reels according to the operation of the operation unit by a player; a function for stopping the rotation of the plurality of reels and forming a symbol sequence in the first region of the display unit; a function for displaying at least one symbol block configured of one or a plurality of symbols in the second region of the display unit when a predetermined game condition is satisfied; a function for moving the symbol block displayed in the second region toward the first region in a direction that intersects the rotational direction of the reels and disposing the symbol block in the position overlapping with a symbol sequence formed in the first region of the display unit; a function for superimposing and displaying a symbol for the symbol block in a position where the symbol block overlaps the symbol sequence; and a function for granting an award for a symbol sequence in the first region of the display unit for which the symbol in the symbol block is superimposed and displayed.

One aspect of the present invention is to provide a gaming machine that can provide a novel game in which the game progression is varied, a method for providing a game, and a program.

In one aspect of the present invention, a gaming machine includes an operation unit, a display unit, and control unit. The operation unit accepts operation by a player. The display unit has a first region and a second region. The first region is configured to display a matrix having a plurality of display elements in a predetermined arrangement. The second region is located relative to the first region. The control unit is connected to the operation unit and the display unit and is configured to randomly establish a symbol for each of the display elements and to display the symbols within the respective display elements forming a first outcome. The control unit being further configured to:

randomly establish a block of replacement display elements, the block of replacement display elements, the block of replacement display elements having an established shape, at least one of the replacement display elements having a replacement symbol;

establish at least two sub-blocks of replacement display elements, the at least two sub-blocks of replacement display elements have respective shapes and being arrangeable to form the established shape of the block of replacement display elements;

display the at least two sub-blocks of replacement display elements in the second region, the location of the at least two sub-blocks in the second region being determined as a function of a set of predefined rules;

move the at least two sub-blocks of replacement display elements from the second region to the first region in a manner to such that the block of replacement display elements is formed by the at least two sub-blocks; and stop movement of the least two sub-blocks of replacement display elements such that the block of replacement display elements overlap at least a portion of the grid of display elements, wherein the replacement symbol within the at least one of the replacement symbol elements replacing the symbol within a corresponding display element, the replacement symbol within the at least one of the replacement symbol elements and the symbols in display elements forming a second outcome.

BRIEF DESCRIPTION OF THE DRAWINGS

FIG. 4 is a diagram illustrating one example of the virtual reel strip displayed in the symbol display region in FIG. 3.

FIG. 13 is a diagram illustrating a symbol block of a different aspect.

DESCRIPTION OF EMBODIMENTS

Below, a gaming machine according to Embodiment 1 of the present invention is described with reference to the appended drawings. Further, duplicated descriptions will be omitted for identical attached symbols in identical or corresponding parts in each figure.

Figure 1:
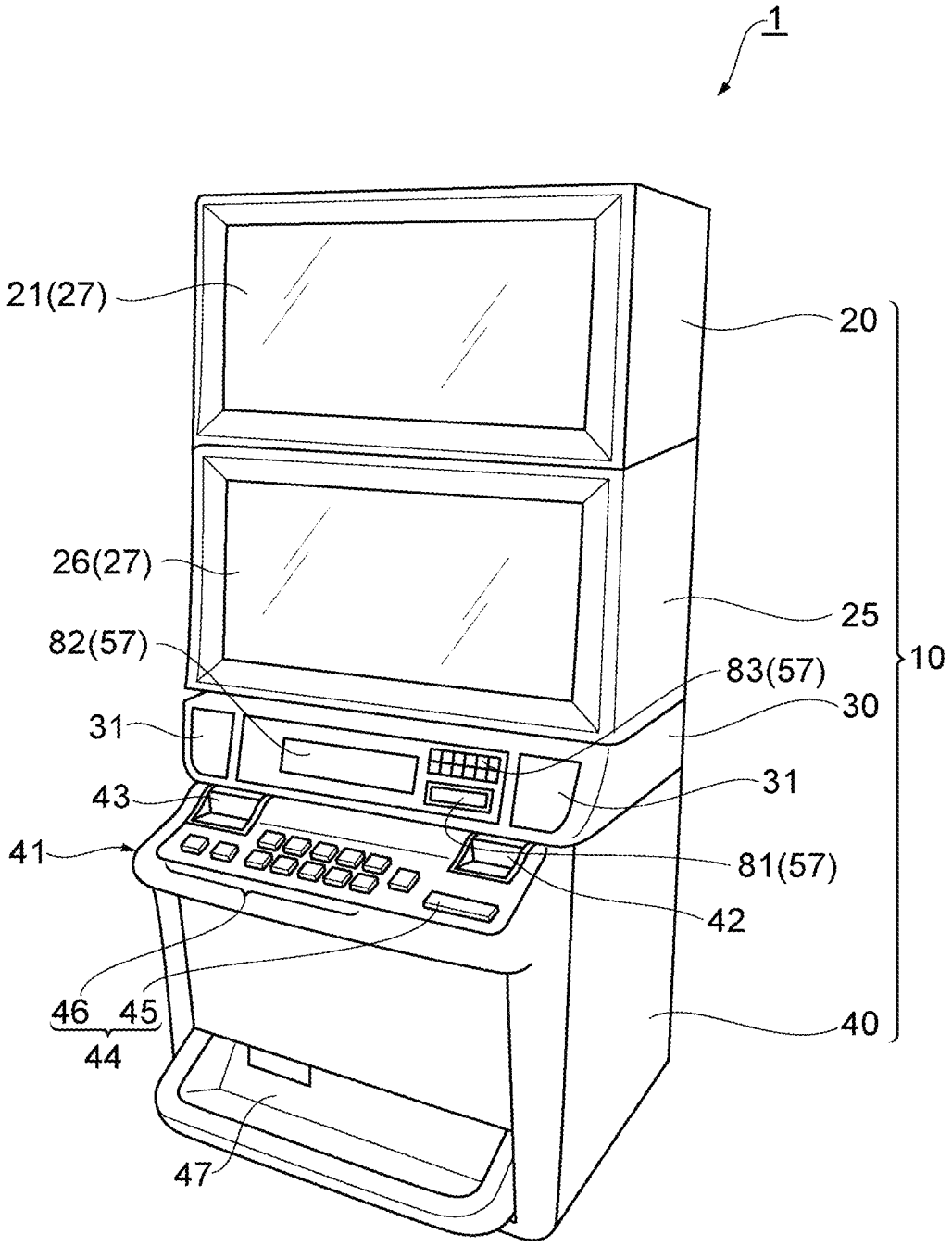
FIG. 1 is a perspective view of the gaming machine according to a first embodiment.

The gaming machine according to the present embodiment receives a predetermined game value from the player, generates a game result, and provides a payout to the player according to the game result. FIG. 1 is a perspective view of a gaming machine 1 according to the first embodiment. As shown in FIG. 1, this gaming machine 1 provides a housing 10 configured from a first cabinet 20 providing an upper display 21, a second cabinet 25 providing a lower display 26, a third cabinet 30 that houses a player tracking unit 57, and a fourth cabinet 40 that provides a control panel 41 and also houses a control unit 50 that controls each part. Each configuration is described below.

The first cabinet 20 is provided on the upper part of the housing 10, and the second cabinet 25 is provided below the first cabinet 20. The upper display 21 provided on the first cabinet 20 and the lower display 26 provided on the second cabinet 25 are flat panel display devices such as both liquid crystal display devices and organic EL display devices and the like, and by controlling via each control unit 50 the game screen mentioned below functions as a display unit 27 provided to the player.

The third cabinet 30 is provided below the second cabinet 25. Speakers 31 are provided on the left and right of the front surface of the third cabinet 30, and by controlling via the control unit 50, sound is provided to the player. Further, the player tracking unit 57 is housed on the center of the front surface of the third cabinet 30. The player tracking unit 57 has a card reader 81 that recognizes a player identification card, a display 82 that presents data to the player, and a keypad 83 that receives input by the player. This type of player tracking unit 57, reads information recorded on the player identification card inserted by the player into the card reader 81, and displays the information and/or information acquired by communicating with the external system on the display 82, by cooperatively operating with the control unit 50 mentioned below or an external system. Further, input from the player is received by the keypad 83, the display of the display 82 is changed according to the input, and communication with the external system is carried out as necessary.

The fourth cabinet 40 is provided below the third cabinet 30. On the fourth cabinet 40, one part is made to project from a front side, and the control panel 41 is provided. On the control panel 41, a bill/ticket identification unit 42, the printer unit 43, and an operation part 44 are provided.

The bill/ticket identification unit 42 is disposed on the control panel 41 in a state where the insertion opening that a bill or ticket is inserted into is exposed, an identification part that identifies a bill/ticket by various sensors on the inside of the insertion opening is provided, and a bill/ticket storage part is provided on the outgoing side of the identification part on the inside of the fourth cabinet 40. The bill/ticket identification unit 42, receives and identifies bills and tickets (including vouchers and coupons) that are the game value as a game executing value, and notifies the control unit 50 mentioned below.

The printer unit 43 is disposed on the control panel 41 in a state where the ticket output opening that a ticket is output from is exposed, a printing part that prints predetermined information on a printing paper on the inside of the ticket output opening is provided, and a housing part that houses the printing paper inside the paper inlet side of the printing part is provided. The printer unit 43, under the control of the control unit 50 mentioned below, prints information on paper and outputs a ticket according to credit payout processing from the gaming machine 1. The output ticket can use the payout credit for game play by being inserted into the bill/ticket identification unit of another gaming machine, or it can be exchanged for cash by a kiosk terminal inside of the casino or a casino cage.

The operation part 44 is a group of buttons that receives various instructions from the player on the gaming machine 1. The operation part 44, for example, has a spin button 45 and a group of setting buttons 46. The spin button 45 receives an instruction to start (start rotating the reel) the game listed below. The group of setting buttons 46 includes a group of bet buttons, a group of line-designated buttons, a max bet button, and a payout button and the like. The group of bet buttons receives an instruction operation regarding the bet amount of credits (bet number) from the player. The group of line-designated buttons receives from the player an instruction operation that designates a line (referred to as an effective line below) subjected to a line determination described below. The max bet button, receives from the player an instruction operation for a bet of the maximum amount of credits that can be bet at one time. The max bet button, receives an instruction operation regarding the bet of the maximum amount of credits that can be bet at one time from the player. The payout button receives from the player an instruction operation instructing a credit payout accumulated in the gaming machine 1.

Further, on the inside of the fourth cabinet 40, a control board equipped with a central processing unit 51 (abbreviated as CPU below) that configures the control unit 50, an interface part 52, a memory 53, a storage 54, and the like is incorporated. The control board, configured so that communication is possible through the interface part 52 and each of the components equipped on the first cabinet 20, the second cabinet 25, the third cabinet 30, and the fourth cabinet 40, controls the operation of each part by executing the program recorded in the memory 53 or the storage 54 of the CPU 51, and provides a game to the player.

Figure 2:
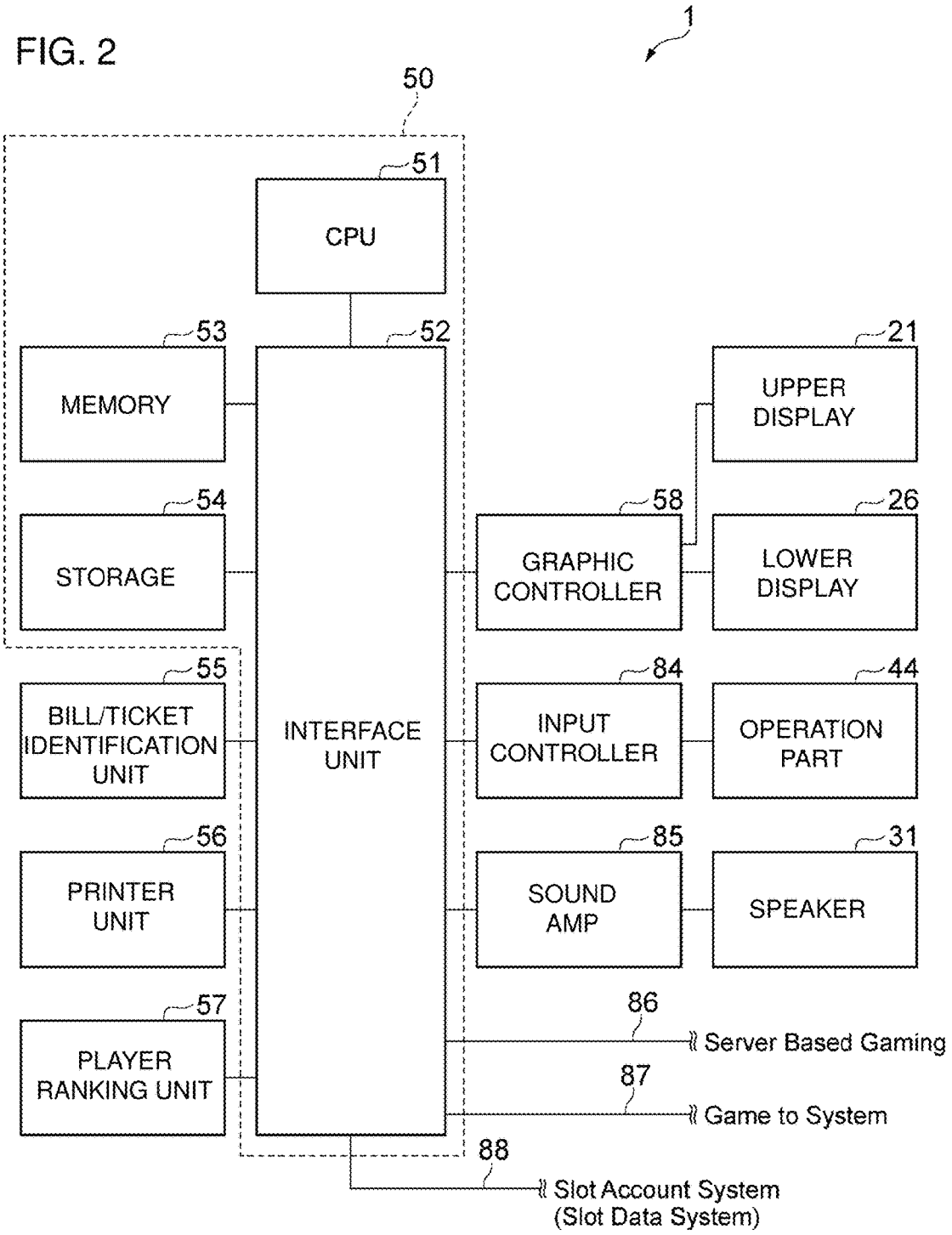
FIG. 2 is a block diagram of the gaming machine in FIG. 1.

FIG. 2 shows a functional block diagram of the gaming machine 1 according to the present embodiment. The gaming machine 1 provides the control unit 50. The control unit 50 is configured as the interface part 52 including a chip set providing communication functions of the CPU 51, a memory bus connected to a CPU, various expanding buses, serial interfaces, USB interfaces, Ethernet (registered trademark) and the like, and a computer unit where the CPU 51 provides the addressable memory 53 and the storage 54 through the interface part 52. The memory 53 can be configured to include RAM that is a volatile storage medium, ROM that is a nonvolatile storage medium, and EEPROM that is a rewritable nonvolatile storage medium. The storage 54 provides the control unit 50 as an external storage device function, can use reading devices such as a memory card that is a removable storage medium, and a magneto optical disk and the like, and can use hard disks.

On the interface part 52, in addition to the CPU 51, the memory 53, and the storage 54, a bill/ticket identification unit 55, a printer unit 56, the player tracking unit 57, a graphic controller 58, an input controller 84, and a sound amp 85 are connected. Note that, when illumination that provides decorative lighting to the gaming machine 1 is provided, the illumination is controlled under the control of the control unit 50 on the interface part 52, and an illumination controller that provides a decorative lighting effect may be connected.

The control unit 50 that has such memory 53 and storage 54, controls each part by executing a program stored in the memory 53 and the storage 54, and provides a game to the player. Here, for example, the memory 53 and storage 54 may be configured to store a program and data of an operating system and subsystem that provide the basic functions of the control unit 50 to the EEPROM of the memory 53, and there may be a configuration that stores a program and data of an application that provides a game to the storage 54. According to such a configuration, it can be easy to change or update a game by replacing the storage 54. Further, the control unit 50 may be a multiprocessor configuration that has a plurality of CPUs.

Each block connected to the control unit 50 is described below.

The bill/ticket identification unit 55 corresponds to the bill/ticket identification unit 42, receives bills or tickets in the insertion opening, and notifies the control unit 50 identifying information corresponding to the payout processing of an assortment of bills or credits. The bill/ticket identification unit 55 notifies the information to the control unit 50, and the control unit 50 increases the usable credit amount inside of the game according to the notified content. The printer unit 56 corresponds to the printer unit 43, and under the control of the control unit 50 that receives an operation of the payout button of the group of setting buttons 46, information corresponding to the credit payout processing from the gaming machine 1 is printed and output on a printed ticket.

The player tracking unit 57 cooperatively operates with the control unit 50, and sends and receives information and the like of the player between the casino management system. The graphic controller 58 controls the upper display 21 and the lower display 26, under the control of the control unit 50, and displays a display image that includes various graphic data. The sound amp 85 drives the speakers 31 under the control of the control unit 50, and provides various sounds such as an announcement, sound effects, BGM and the like.

Further, the interface part 52, has various communication interfaces for communicating with the exterior of the gaming machine 1, for example can communicate with an external network by Ethernet 86, 87, and a serial output 88. In the present embodiment, one example shows when there is communication between a well-known server based gaming network (Server Based Gaming of FIG. 2), a G2S network (Game to System of FIG. 2), and a slot information system (Slot Data System of FIG. 2), respectively.

Referring to FIG. 1, in one embodiment, referring to FIG. 1, the control panel 41 includes a plurality of user input devices that may include an acceptor device which accepts media associated with a monetary value to establish a credit balance, a validator configured to identify the physical media, a cash-out button actuatable to cause an initiation of a payout associated with the credit balance. The acceptor device may include a touchscreen display associated with the display unit 27 and/or the player tracking unit 57, the paper money/ticket identification unit 42, the operation unit 44, the player tracking unit 57, a coin slot, a ticket in ticket out (TITO) system, a bill acceptor, and/or any suitable device that enables the gaming machine 1 to receive media associated with a monetary value and establish a credit balance for use in playing the gaming machine. In one embodiment, the acceptor device may be configured to receive physical media such as, for example, a coin, a medal, a ticket, a card, a boll, currency, and/or any suitable physical media that enables the gaming machine 1 to function as described herein. The acceptor device may also be configured to accept virtual media such as, for example, a player tracking account, a virtual credit balance, reward points, gaming credits, bonus points, and/or any suitable virtual media that enables the gaming machine 1 to function as described herein. For example, in one embodiment, the coin slot may include an opening that is configured to receive coins and/or tokens deposited by the player into the gaming machine 1. The control unit 50 converts a value of the coins and/or tokens to a corresponding amount of gaming credits that are used by the player to wager on games played on the gaming machine 1. The bill acceptor may include an input and output device that is configured to accept a bill, a ticket, and/or a cash card into the bill acceptor to enable an amount of gaming credits associated with a monetary value of the bills, ticket, and/or cash card to be credited to the gaming machine 1. In one embodiment, the bill acceptor also includes a printer (not shown) that is configured to dispense a printed voucher ticket that includes information indicative of an amount of credits and/or money paid out to the player by the gaming machine 1 during a gaming session. The voucher ticket may be used at other gaming devices, or redeemed for cash, and/or other items as part of a casino cashless system.

Figure 3:
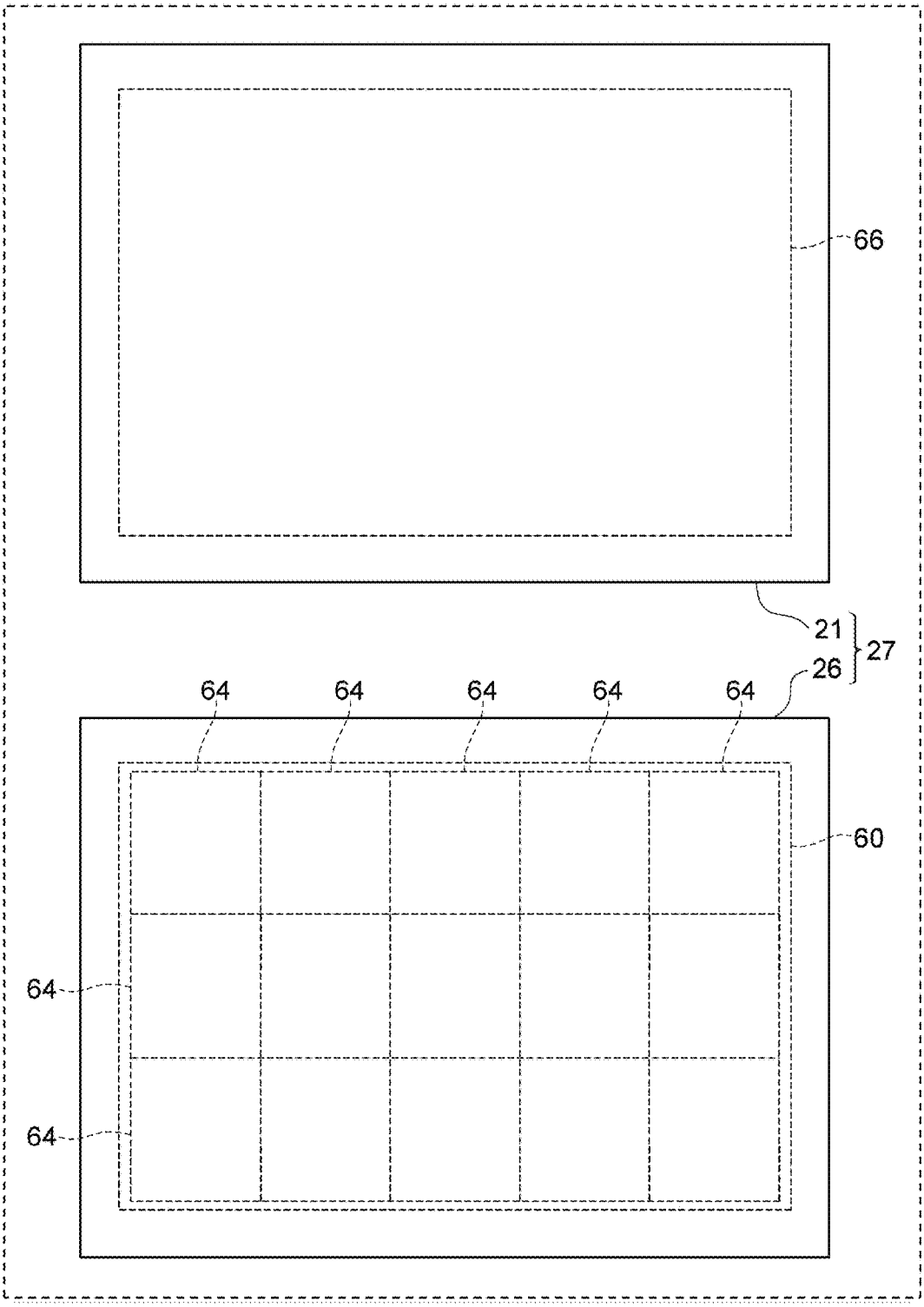
FIG. 3 is a schematic diagram illustrating one example of the symbol display region and the block display region of the display unit in the gaming machine in FIG. 1.

FIG. 3 is a figure schematically showing a game screen provided by the gaming machine 1 according to the present embodiment. Such a game screen displays on the upper display 21 and the lower display 26 of the display unit 27 by the control unit 50 executing a predetermined program. In the illustrated embodiment, the game screen in the lower display 26 has a symbol display region 60 for displaying symbols. The gaming machine 1 of the present embodiment displays a symbol sequence, which is the game result, in the symbol display region 60 by redisplaying symbols displayed in the symbol display region 60 as compensation for a predetermined game value, and operates as a slot machine that grants an award according to this symbol sequence.

It should be noted, though omitted in FIG. 3, that a credit amount, number of bets, a region for displaying a credit amount (number of WINs), and the like, obtained in wins, and a decoration region may also be provided in the lower display 26 other than the symbol display region 60.

The symbol display region 60 is configured by a plurality of display elements or cells 64, which is the stopping position of a symbol. Specifically, the symbol display region 60 is configured by 15 cells arranged in a grid pattern of 3 rows and 5 columns. It should be noted that below, the horizontal direction and the vertical direction of the display unit 27 are referred to as the row direction and the column direction respectively.

A boundary line of the cells 64 may be displayed on the lower display 26 in a state that is visually comprehensible to a player, or the display may be omitted. That is, the cells 64 are sufficient if logically or ideally defined within the gaming machine 1 as a symbol stopping position, and a visible boundary therefor is not necessarily required.

A prescribed symbol based on the symbol sequence in the virtual reel strips 71 to 75, which forms a virtual reel set 70 as illustrated in FIG. 4, is displayed in each cell 64 in the symbol display region 60. That is, the virtual reel strips 71 to 75 are associated by column, and a prescribed, partially disposed symbol in each virtual reel strip 71 to 75 is displayed. Further, symbols displayed on the cells 64 in the symbol display region 60 are varied by moving (scrolling) symbols in each column based on a symbol sequence in the virtual reel strips 71 to 75, and the symbols are stopped by stopping the movement (scrolling) of each column. Here, the virtual reel strips 71 to 75 are data used in a program by the control unit 50 in the memory 53 or the storage 54, and is the data that shows the symbol sequence (that is the alignment sequence of symbols in each reel) prescribed for each column of cells. Further, the virtual reel set 70 is a generic name for this type of virtual reel strip 71 to 75. Each virtual reel strip 71 to 75 is configured of the 19 symbols in the example in FIG. 4 and aligned in an order defined for each reel by these symbols. In the present embodiment, three symbols in the virtual reel strip 71 to 75 are each displayed in the symbol display region 60. In addition to above, in one embodiment, 15 independent reels may be used, where each independent reels corresponds to an individual cell 64 and spin/stop respectively.

Figure 5A:
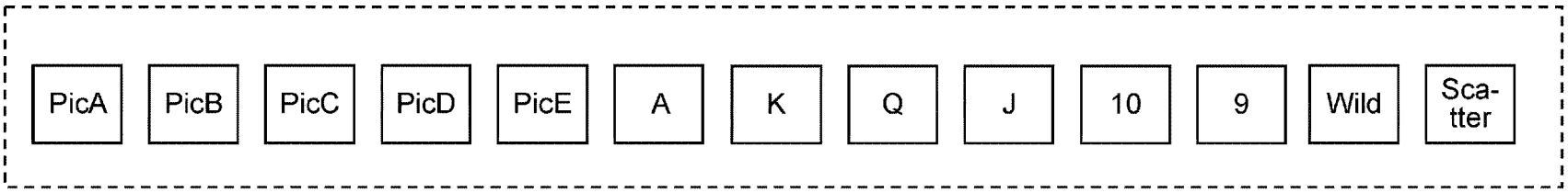
FIGS. 5A and 5B are diagrams illustrating a type of symbol displayed in the symbol display region.
Figure 5B:
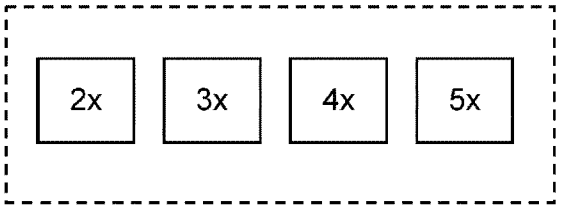

The variety of symbols that configure the virtual reel strips 71 to 75 illustrated in FIG. 4 are illustrated in FIG. 5 (*a*). Each symbol configuring the virtual reel strips 71 to 75 are, respectively, five types of picture symbols ("Pic A," "Pic B," "Pic C," "Pic D," and "Pic E"), six types of card symbols ("A," "K," "Q," "J," "10," and "9"), a wild symbol ("Wild"), and a scatter symbol ("Scatter").

Card symbols are symbols that represent each design used in playing cards, and are the lowest ranking symbols in the symbols configuring the virtual reel strips 71 to 75.

Picture symbols are symbols that show each type of picture in a treasure chest or a diamond, and the like, and are higher ranking symbols than the card symbols.

The wild symbol is a symbol that passes as another symbol (that is a symbol substituted as another symbol) upon a winning determination in a normal game, described below, and can configure a winning combination with an unspecified symbol. A wild symbol is one of the highest ranking symbols in the symbols configuring the virtual reel strips 71 to 75. The virtual reel strips 72, 73, and 74 of the present embodiment include a wild stack symbol (a continuous group of symbols composed of three successive "Wild"s), and in FIG. 4 the wild stack symbol is represented by a "Wild" symbol, which is vertically long when compared to other symbols.

The scatter symbol is a symbol used upon the winning determination of a special game, described below, and is provided in a special game according to the number of scatter symbols in the symbol display region 60. Similar to a wild symbol, a scatter symbol is also one of the highest ranking symbols in the symbols configuring the virtual reel strips 71 to 75.

A high ranking symbol easily provides a large payout when a prize is won compared to a low ranking symbol or easily configures a winning combination. Further, a high ranking symbol easily wins in a special game compared to a low ranking symbol. Therefore, the more high ranking symbols are displayed in the symbol display region, the more a game becomes advantageous for a player.

A multiplier wild symbol displayed on the game screen under special conditions is illustrated in FIG. 5 (*b*). The multiplier wild symbol is a wild symbol to which a multiple is applied, and the multiple applied to the symbol is applied to the amount of a winning payout when a winning combination is configured by the symbols. It should be noted that a design indicating a multiple may be employed in the multiplier wild symbol in order to explicitly indicate to a player that a multiple predetermined by a wining payout is being multiplied.

Figure 6:
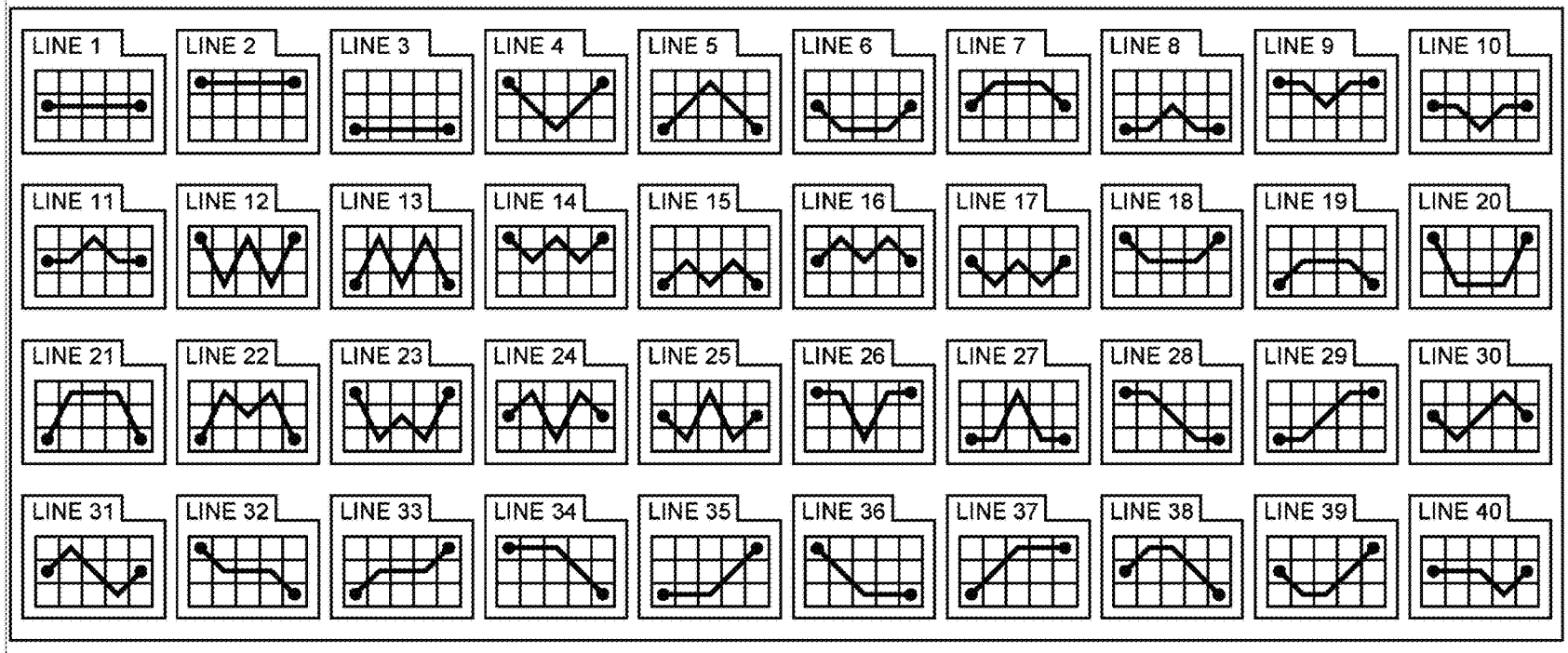
FIG. 6 is a diagram illustrating one example of a pay line set in the symbol display region.

A pay line used upon a winning determination is set in the symbol display region 60. The pay line is set so as to span from a cell in the column on the left edge to a cell in the column on the right edge, and is a line composed of the combination of a plurality of cells 64 that form the objective of a winning determination. The number of an effective line in a set pay line is selected by a player via operation of a group of line indication buttons included in the group of set buttons 46 in the operation unit 44. For a symbol sequence, which is a game result, the control unit 50 determines a win, for example, when a same symbol exceeds a predetermined number and is aligned on a set pay line, and pays a player a payout according to the type of symbol and the number. In the gaming machine 1 of the present embodiment, a predetermined number of pay lines (LINE 1 to 40) are set for a three row five column cell in the symbol display region 60 (see FIG. 6). The method for a winning determination may determine a win when a predetermined number of a same symbol are aligned on a predetermined pay line from a cell in the column on the left edge, may determine a win when a predetermined number of a same symbol are aligned on a predetermined pay line from a cell in the column on the right edge, or may determine a win when a predetermined number of a same symbol are aligned in any adjacent columns on a predetermined pay line.

Returning to FIG. 3, the game screen in the upper display 21 has a block display region 66 for displaying symbol blocks described later. The block display region 66 is aligned with the symbol display region 60 with respect to the direction of reel rotation (the upper and lower directions of FIG. 3).

The gaming machine 1 for the present embodiment provides three types of games including a normal game, which is provided when a predetermined condition is not met (also referred to as a main game or a prime game), a first special game, and a second special game, which are provided when a predetermined condition is met. The first special game is a feature game wherein an advantageous feature function, described later, is applied for a player when a predetermined trigger condition is met. The second special game is a free game wherein a predetermined number of free games that do not consume game value are provided when a predetermined trigger condition is met.

In the normal game, the first special game, and the second special game described above, a symbol displayed in the symbol display region 60 in a symbol sequence, which is a game result, becomes the objective of a winning determination. That is, the control unit 50, which starts a game, randomly determines a stopping position for each of the virtual reel strips 71 to 75 illustrated in FIG. 4, the virtual reel strips 71 to 75 move from their current positions, and the operation of stopping at a stopping position is expressed using the bottom display 26. By this, in the symbol display region 60, a symbol arrayed on the virtual reel strips 71 to 75 continuously moves (scrolls) in the vertical direction, and is stopped so as to display one symbol in one cell 64 while maintaining continuity.

However, in the present embodiment the feature function described below is applied during a feature game, and as a result a symbol sequence displayed once in the symbol display region 60 is changed to a different symbol sequence.

The symbol replacement process, which is a process of the feature function applied during a feature game, is described below with reference to FIG. 7 to FIG. 10.

Figure 7A:
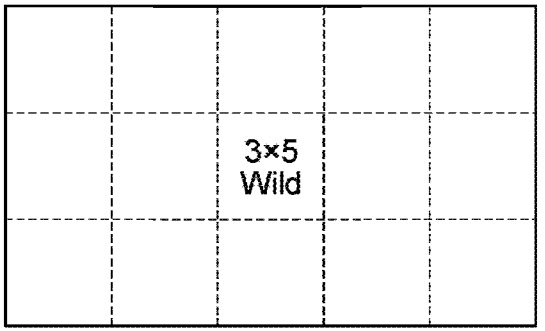
FIGS. 7A-7H are diagrams illustrating a type of symbol block displayed in the block display region.
Figure 7B:
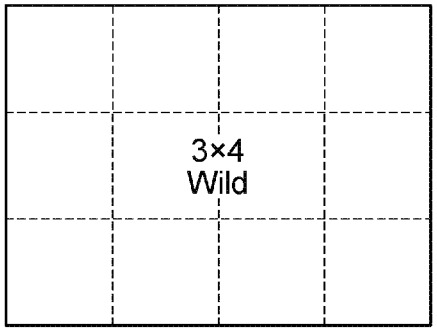
Figure 7C:
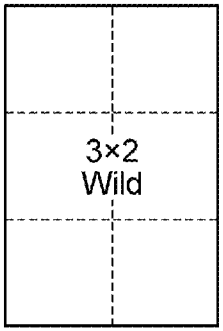
Figure 7D:
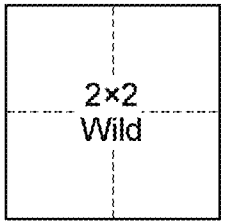
Figure 7E:
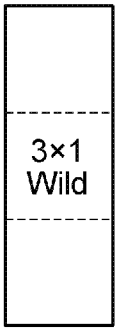
Figure 7F:
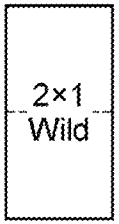
Figure 7H:
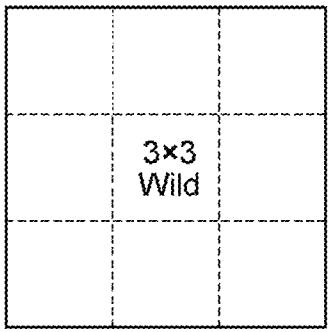
Figure 7G:
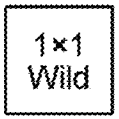

The symbol block displayed in the block display region 66 is described with reference to FIGS. 7A-7H. A symbol block is a rectangular block of each type of size expressed by a row m and a column n (m and n are natural numbers) as illustrated in FIGS. 7A-7H. For example, FIG. 7A illustrates a symbol block of three rows and five columns, which is the same as the cells configuring the symbol display region 60. Similarly, FIGS. 7B-7H illustrate symbol blocks of three rows and four columns, three rows and two columns, two rows and two columns, three rows and one column, two rows and one column, one row and one column, and three rows and three columns. In the example in FIG. 6, the symbols comprising each symbol block are all wild symbols. Each symbol block, when displayed in the block display region 66, moves to a position different than the symbol sequence in the symbol display region 60, and is displayed superimposing a symbol from the symbol block (that is, a wild symbol) in a position of an overlapping symbol sequence. Here, a single picture is depicted in each symbol block of the present embodiment. That is, a same picture or a picture of the same theme as a wild symbol is depicted in each symbol block by size according to the size of the symbol block becoming a visually powerful configuration.

The control unit 50 determines the number and size of a symbol block displayed in the block display region 66 by the procedure below.

The control unit 50 first determines a replacement pattern, or block of replacement display elements, based on a random value. For instance, the block of replacement display elements may be randomly selected from a set of predetermined block of replacements display elements. Alternatively, the block of replacement display elements may be dynamically determined based randomly determining whether individual replacement display elements are to be included in the block of replacement display elements. Alternatively, replacement pattern or block of display element may be determined based on an imaginary/internal spin and stop of another reel set which provide 5 column and 3 raw combination of replacement position and non-replacement position. In this case, each reel of the reel set may use another virtual reel strip having replacement position and non-replacement position for each column of cell 62 and its stop position may be determined by another random number. Thus, the combination of replacement position configured by the stopped reels may be used as the replacement pattern or block of display element.

Figure 8:
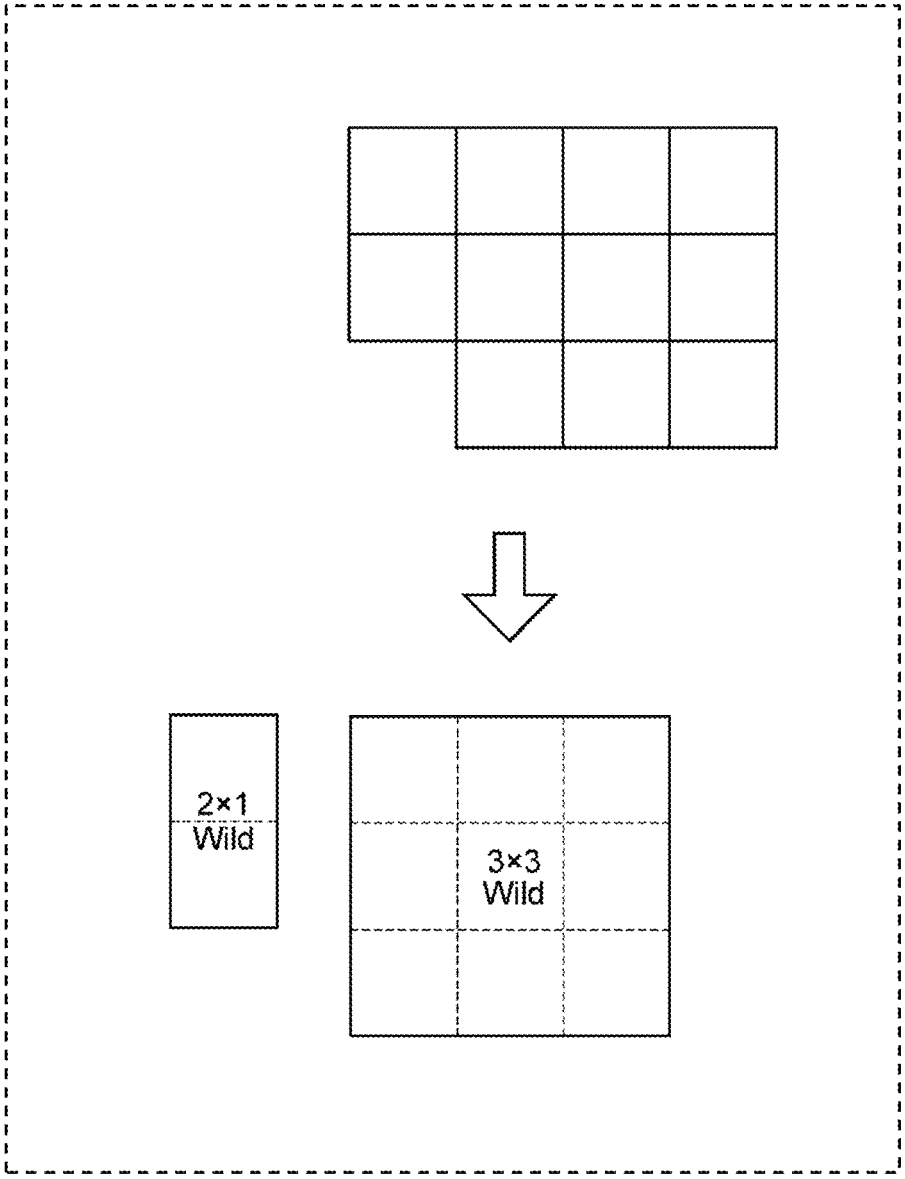
FIG. 8 is a diagram illustrating one example of an aspect that divides a replacement pattern by a symbol block.
Figure 9:
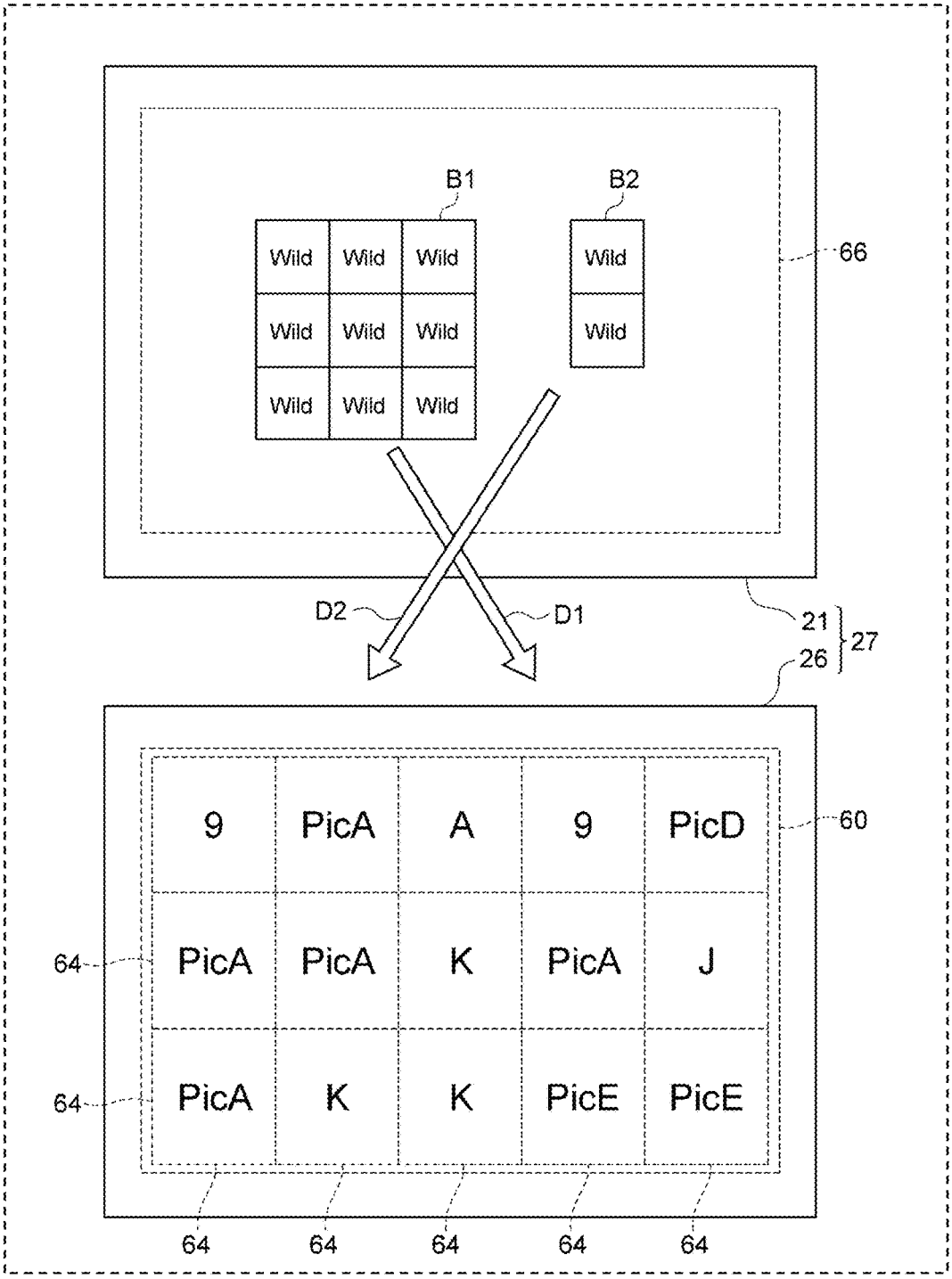
FIG. 9 is a diagram illustrating a state prior to the movement of a symbol block displayed in the block display region.

The replacement pattern is a pattern for replacing a symbol sequence in the symbol display region 60, and the largest determinable size is three rows and five columns. Further, a replacement pattern is divided into a plurality when a determined replacement pattern is not any of the symbol blocks illustrated in FIG. 7 (*a*) to (*h*) in order to correspond to the symbol blocks illustrated in FIG. 7 (*a*) to (*h*), as illustrated in FIG. 8. In the example in FIG. 8, a replacement pattern is divided into two symbol blocks, or sub-blocks of replacement display elements, including a symbol block of two rows and one column and a symbol block three rows and three columns. When a replacement block is divided as described above, the divided symbol block becomes a symbol block other than a symbol block of three rows and five columns (that is, any of a symbol block of three rows and four columns, three rows and two columns, two rows and two columns, three rows and one column, two rows and one column, one row and one column, or a three rows and three columns). In other words, the replacement pattern or the block of display element is divided when its shape is not rectangle in this embodiment.

The control unit 50 displays a plurality of divided symbol blocks on the block display region 66 according to a predetermined rule. In the example illustrated in FIG. 9, the two symbol blocks B1 and B2 are aligned from the left of the block display region 66 in order of the number of symbols configuring the symbol blocks. That is, the symbol block B1 of three rows and three columns is displayed on the left side of the block display region 66, and the symbol block B2 of two rows and one column is displayed on the right side of the block display region 66. The rules for displaying the symbol blocks are not limited to this and may determine the display positions in advance by the size of the symbol blocks, superimpose and display a portion or an entire symbol block, or display while moving the display positions of the symbol blocks on the screen. Further, a small symbol block or the precursor of a symbol block can also be generated in a predetermined position, and be in a state facing the symbol display region 60 while expanding and moving as described later.

The control unit 50 moves each symbol block B1 and B2 displayed in the block display area 66 downward to the symbol display region 60 so that each symbol block B1 and B2 is arranged in a position overlapping with a symbol sequence in the symbol display region 60. At this time, each symbol block B1 and B2 moves so as to reproduce the shape of the replacement pattern described above in the symbol display region 60 in this embodiment. That is, the symbol block B1 moves in a downward diagonal direction to the right (the direction of the arrow D1 in FIG. 9), and the symbol block B2 moves in a downward diagonal direction to the left (the direction of the arrow D2 in FIG. 9).

Figure 10:
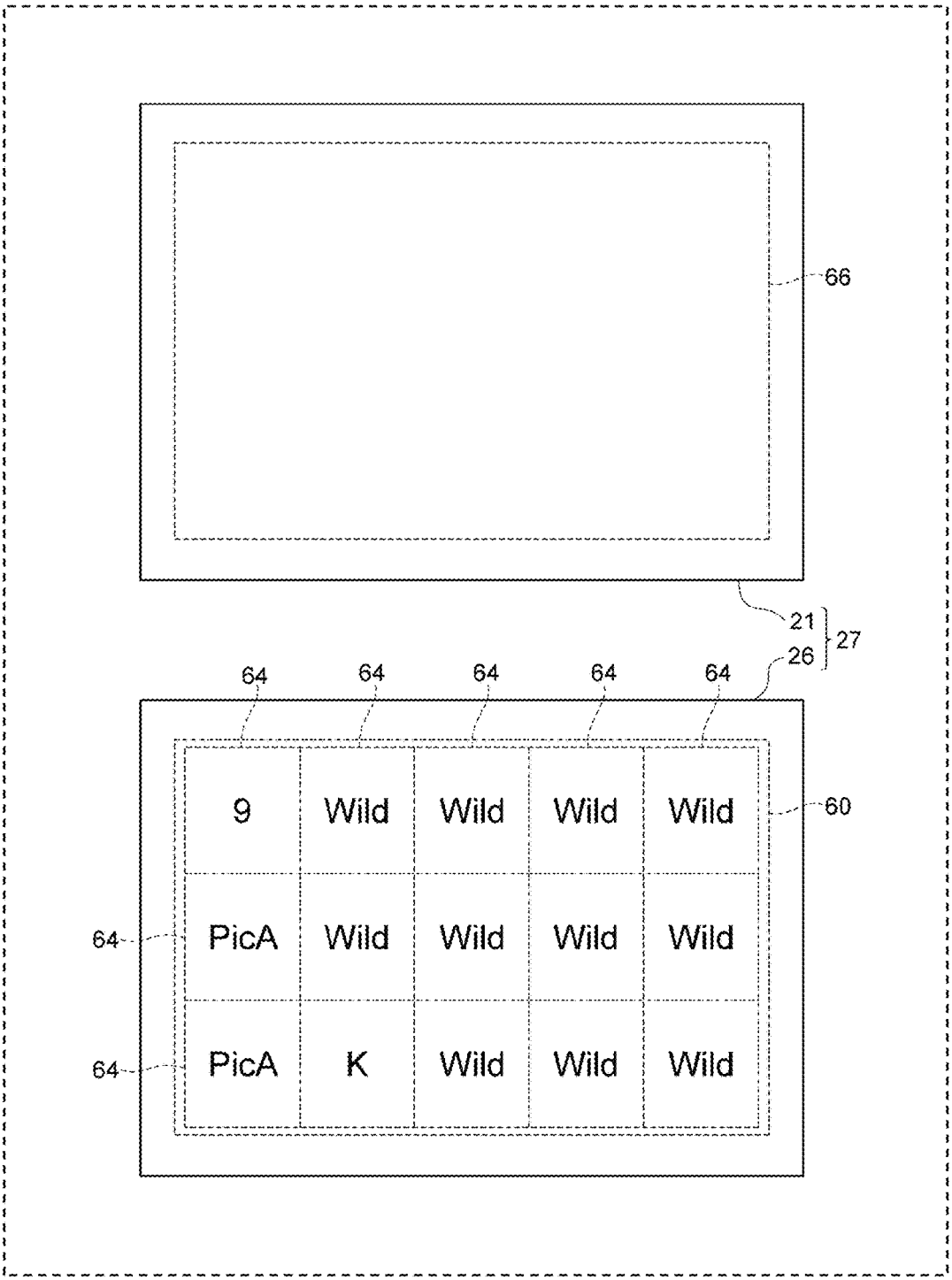
FIG. 10 is a diagram illustrating a state after the movement of the symbol block.

As a result, the shape of the replacement pattern is reproduced in the symbol display region 60 as illustrated in FIG. 10, and, a symbol in a position corresponding to a replacement pattern is replaced by a wild symbol by the superimposition and display of a wild symbol for the positioned symbol. Further, the control unit 50 determines a symbol sequence in the symbol display region 60 after replacement is carried out by a replacement pattern.

Figure 11:
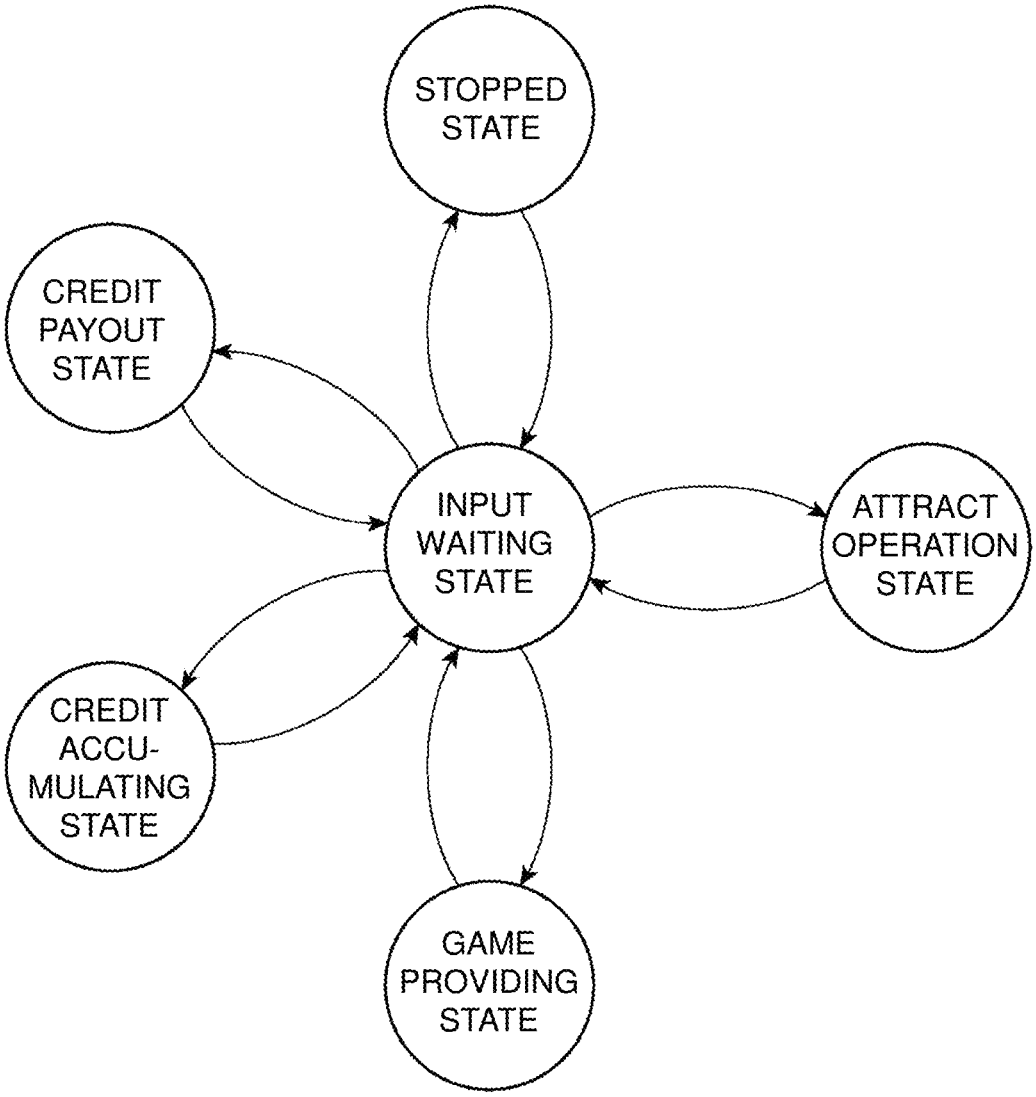
FIG. 11 is a state transition diagram of the gaming machine.

Next, an operation of the gaming machine 1 according to the present embodiment is described while referencing FIG. 11. FIG. 11 is an illustration of a state transition diagram of the gaming machine 1 according to the present embodiment configured as described above. As illustrated in FIG. 11, the gaming machine 1 takes on each state including a stopped state, an awaiting input state, a credit payout state, a credit accumulation state, an operation attraction state, and a game providing state. Each state is described below.

The stopped state is a state in which the gaming machine 1 is not operating. The gaming machine 1 in the stopped state activates and initializes when accepting a predetermined activation operation, a predetermined program is executed by the control unit 50, a game screen is displayed on the display unit 27, then it enters the awaiting input state.

The gaming machine 1 in the awaiting input state transitions to a credit accumulation state, which accumulates corresponding credit information within the gaming machine 1 whenever the bill/credit identification unit 55 identifies a bill or a credit, and returns to the awaiting input state when credit accumulation has ended. Further, the gaming machine 1 in the awaiting input state transitions to the credit payout state, which carries out accumulated credit payout processing when an operation of the payout button is received in a state in which credit information is accumulated, and along with outputting a ticket printed with information corresponding to the credit payout processing from the printer unit 56, accumulated credit within the gaming machine 1 returns to zero. The gaming machine 1, having finished these processes, returns to the awaiting input state.

The gaming machine 1 in the awaiting input state transitions to the operation attraction state, which displays an attractive screen on the display unit 27, if not operated within a predetermined time. The gaming machine 1 in the operation attraction state returns to an awaiting input state when an operation is received. It should be noted that the attraction screen is a screen meant to draw the attention of customers in the casino to the existence of the gaming machine 1, and is composed of a predetermined image and/or video.

The gaming machine 1 in the awaiting input state sets a line number and a bet number in a game by receiving an operation from a line selection button, a bet number selection button, or a max bet button in a state in which credit has been accumulated therein, decreases the credit amount by only the credit amount times the line number set via reception of the operation of a start button then transitions to a game providing state. In the game providing state, a game is provided according to the flowchart illustrated in FIG. 12. Further, transitioning to the game providing state according to the operation of the bet number selection button or the max bet button is acceptable.

Figure 12:
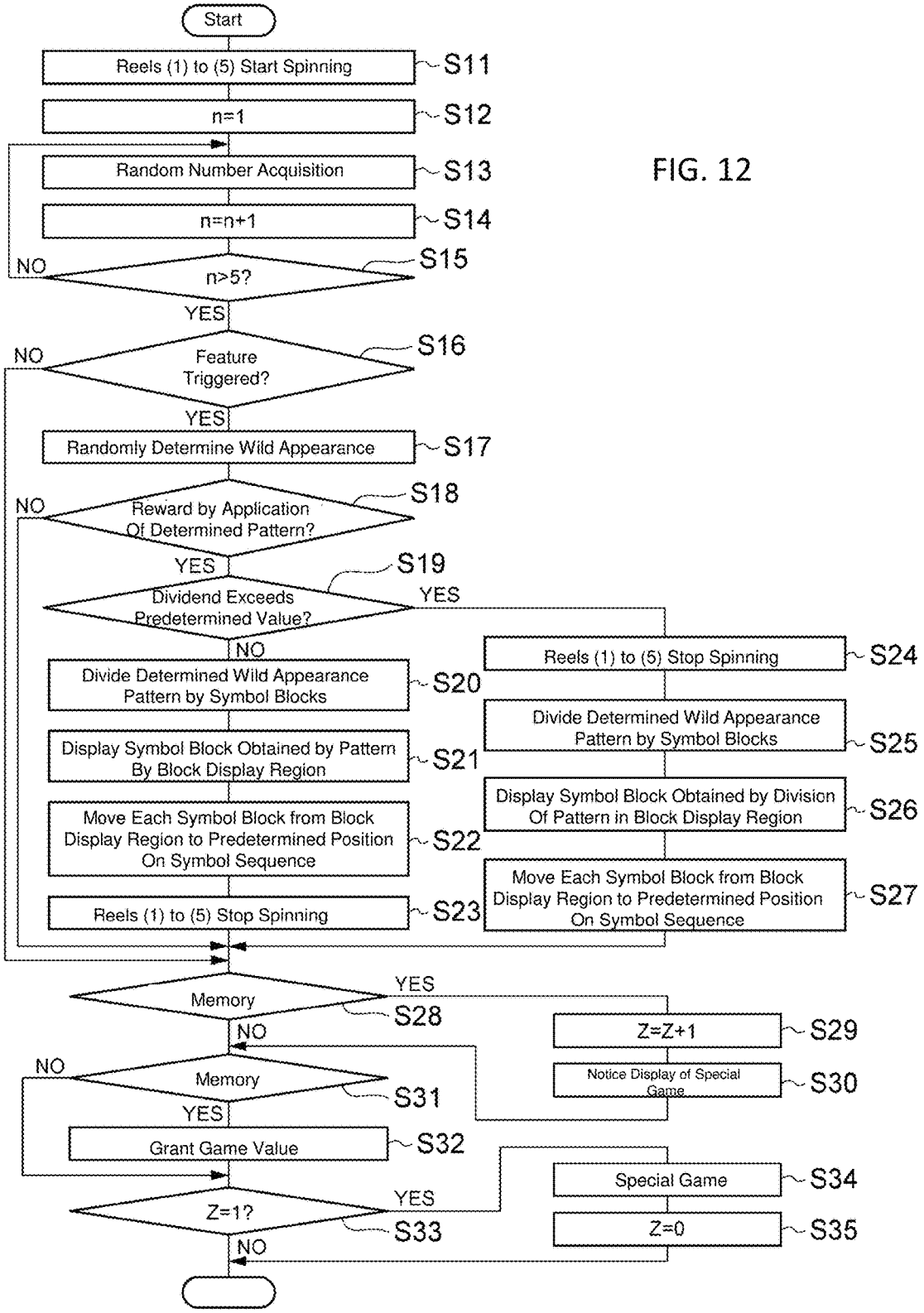
FIG. 12 is a flowchart describing the operation of the gaming machine in FIG. 1.

Below, an operation in the game providing state is described as a method for controlling for the gaming machine 1 while referencing the flow chart illustrated in FIG. 12.

A line number and a bet number are set in the awaiting input state, the gaming machine 1 having transitioned to the game providing state by receiving an operation from the start button starts a normal game by controlling the top display 21 and the bottom display 26 via the control unit 50.

First, a spin of reel (1) through reel (5) being displayed in the symbol display region 60 is started in S11. More specifically, a column of symbols being displayed in the symbol display region 60 are scrolled in a defined order in each corresponding virtual reel strip 71 to 75, and a state where the reels are rotating is virtually displayed. Subsequently, a parameter of n=1 is set as an initial process by the control unit 50 in the process of S12.

Next, in the process of S13, the control unit 50 acquires a random number for determining the stopping position of each reel (n). The method whereby the control unit 50 acquires a random number may be in accordance with the regulations of a jurisdiction where the gaming machine 1 is installed, but is not limited to a particular method. After acquisition of a random number, the process proceeds to S14.

In the S14 process, the control unit 50 is made to be n=n+1. After setting, the process proceeds to S15. In the S15 process, it is determined whether the control unit 50 satisfies n>5. When n>5 is not satisfied, the process proceeds to S13. By this, until n>5 is satisfied, processes S13 to S15 are repeatedly executed. When n>5 is satisfied in S15, the process proceeds to S16.

In the S16 process, the control unit 50 acquires a random number by the same process as in S13 and determines whether a trigger for applying the feature function described above occurs based on the acquired random number. If it is determined that a trigger has occurred, the process proceeds to S17 for determining the replacement pattern (wild appearance pattern). In S17, the control unit 50 determines the wild appearance pattern using one or a plurality of random numbers. When the wild appearance pattern is determined, the control unit 50 can select using a plurality of wild appearance patterns stored in the memory 53 or the storage 54 in advance, or generate a wild appearance pattern from the plurality applied by each feature function. As mentioned in above, it is possible to determine the replacement pattern by the result of the imaginary/internal spin and stop of aforementioned reel set based on the random number.

The control unit 50 determines whether an award is generated in the S18 process through application of the feature function described above. Further, the S19 process is proceeded to when it is determined that an award will be generated through application of the feature function in the S18 process. That is, 1) the controller determines symbol combination based on the virtual reel strip 71-75 and random numbers, 2) the controller applies determined replacement pattern to the symbol combination, 3) evaluate and accumulate win in the resulted symbol combination.

In the process of S19, the control unit 50 determines whether the value of a winning payout exceeds a predetermined threshold value. Further, a wild appearance pattern is applied before the reels stop when the value of a winning payout is less than the predetermined threshold value, and a wild appearance pattern is applied after the reels stop when the value of a winning payout exceeds the predetermined threshold value. It should be noted that the determination in S19 is not necessarily based on the value of the winning payout, but may also be randomly determined by the application timing of the wild appearance pattern using a random value.

The processes of S20 to S23 proceed when it is determined by the determination in S19 that a wild appearance pattern is applied prior to the reels stopping.

In the S20 process, the control unit 50 divides a wild appearance pattern determined in S17 by an appropriate plurality of symbol blocks. Subsequently, in the S21 process, symbol blocks are aligned and displayed in the block display region 66 based on a predetermined condition. In the S22 process a symbol block is moved from the block display region 66 to the symbol display region 60, and a wild symbol is arranged in a position according to the appearance pattern. In the subsequent process S23, the control unit 50 stops the reels (1) to (5). More specifically, the control unit 50 stops the symbols on each reel scroll-displayed in the symbol display region 60 at a stopping position determined for each virtual reel strip 71 to 75 using a random number acquired in S13. It should be noted that in the position of a symbol block, a wild symbol is displayed instead of a symbol for the stopped virtual reel strips 71 to 75 in this position because the wild symbol is displayed superimposed. As a result, a symbol sequence is displayed in the symbol display region 60 after being replaced by a replacement pattern. Provide that the control unit 50 may omit S20 in case when the wild appearance pattern has corresponding shape with one of previously prepared symbol blocks.

The processes of S24 to S27 proceed when the timing for applying a wild appearance pattern is determined to be after the reels are stopped.

In the first process S24, the control unit 50 stops the reels (1) to (5). More specifically, the control unit 50 stops the symbols on each reel scroll-displayed in the symbol display region 60 at a stopping position determined for each virtual reel strip 70 using a random number acquired in S13. Subsequently, in the S25 process, the control unit 50 divides the appearance pattern determined in S17 by an appropriate plurality of symbol blocks. In the S26 process, symbol blocks are aligned and displayed in the block display region 66 based on a predetermined condition. In the S27 process, a symbol block is moved from the block display region 66 to the symbol display region 60, and a wild symbol is displayed superimposed with respect to a position symbol according to the appearance pattern. By this, a position symbol corresponding to an appearance pattern is replaced by a wild symbol. As a result, a symbol sequence is displayed in the symbol display region 60 after being replaced by a symbol block.

The stopping positions for the reels (1) to (5) correspond to the stopping positions of the corresponding virtual reel strips 71 to 75. Therefore, the stopping position defines a numerical value or a range of numerical values in relation to each symbol in the virtual reel strips 71 to 75, for example, and can determine a position of a symbol related to a numerical value or a range of numerical values including an acquired random number. In this case, by unevenly defining a numerical value or a range of numerical values related to each symbol, a gradient or a bias in the probability of a stopping position can also be provided.

Further, when it is determined that a trigger for applying the feature function of determination in S16 will not be generated, when it is determined that there will be no award even when a wild appearance pattern determined in S18 is applied, and when the series of processes including S22 to S20 or S24 to S27 have ended, the control unit 50 determines whether a predetermined condition in which a symbol displayed in the symbol display region 60 provides a special game is satisfied in the S28 process. As a winning condition of a special game, the realization of a winning combination of symbols predetermined on the pay line (line determination) and/or the appearance of a special symbol (scatter symbol) equal to or greater than a predetermined number in the symbol display region 60 (scatter determination) may be given as examples.

In the present embodiment, a scatter determination is used in a winning determination of a special game. As illustrated in FIG. 4, the virtual reel set 70 includes four scatter symbols, but when three or more scatter symbols are displayed within the symbol display region 60, the control unit 50 determines that a condition providing a special game has been satisfied. In the present embodiment, as a special game, a free game that does not consume game value is provided a predetermined number of times. The control unit 50 determines the number of free games provided as a special game according to the number of scatter symbols. That is, when three or more scatter symbols are displayed within the symbol display region 60 and provision of a special game is determined, the control unit 50 determines that three free games are provided when two scatter symbols are displayed, eight free games are provided when three scatter symbols are displayed, and twelve free games are provided when four scatter symbols are displayed.

When a predetermined condition providing a special game is determined to have been satisfied in S28, a special game providing flag Z is set to Z=1 in S29. After a flag is set in S29, provision of a special game is announced and displayed in the top display 21 or the bottom display 26 in S30.

After S28, when a predetermined condition providing a special game is determined to have been satisfied in S30, in S31 the control unit 50 determines whether a symbol displayed in the symbol display region 60 is a win. However, the predetermined condition for providing a special game (a feature game and a free game) is applied by a separate condition in a winning determination. When determined to be a win, in S32, credit corresponding to a payout is added to the accumulated credit in the gaming machine 1 because the payout, being a predetermined game value (credit), is granted to a player.

After S34, when determined to be a win in S31, and after S31, when not determined to be a win, subsequently, whether a flag Z is set to Z=1 is determined in the S33 process, and when determined to be set to Z=1, the process progresses to S34 and the control unit 50 provides a predetermined number of free games described above as a special game. It should be noted that when a predetermined condition is satisfied during a free game, a modification such as the addition of a number of free games is added in place of the provision of a special game when another predetermined condition is satisfied, and the process proceeds.

When the predetermined number of free games have ended, a plug Z is set to Z=0 in S35 following S34, the gaming machine 1 ends the game providing state and returns to the awaiting input state. Further, when determined that a flag Z is not set to Z=1 in S35, the gaming machine 1 ends the game providing state and returns to the awaiting input state. Operation in the game providing state described above ends.

According to the gaming machine and the method for providing the game therein according to the first embodiment described above, the process of a feature function (that is the provision of a symbol block) is carried out, and a game value is granted for a symbol sequence after the process of a feature function. During the process of a feature function described above, the symbol blocks B1 and B2 displayed in the block display region (second region) 66 are moved so as to be arranged in a position overlapping with a symbol sequence formed within the symbol display region 60 (first region). At this time, the symbol blocks B1 and B2 may be moved in a direction intersecting the rotational direction of the reels (the direction of the arrows D1 and D2 in FIG. 9). Compared to a case in which the symbol blocks B1 and B2 move in the direction of reel rotation, prediction by a player of the positions where the symbol blocks B1 and B2 are finally disposed is difficult when the symbol blocks B1 and B2 move in a direction intersecting the rotational direction of the reels.

That is, when the symbol blocks B1 and B2 move in the rotational direction of the reels, a player can predict the positions to some extent because the positions where the symbol blocks are finally disposed are limited to positions including an upper position, a middle position, and a lower position in the symbol display region 60. Meanwhile, when the symbol blocks B1 and B2 move in a direction intersecting the rotational direction of the reels, not only the upper position, the middle position, and the lower position in the symbol display region 60, but even a position in the row direction must be predicted, and prediction of these position becomes difficult for a player because the movement in the row direction (left to right direction) of the symbol display region 60 changes.

In this way, according to the gaming machine and the method for providing the game therein according to the first embodiment, a novel game can be achieved by making the disposed position of a symbol block difficult to predict because diverse game progression can occur when the symbol blocks are finally arranged. From a different perspective, after the symbol blocks have started to move and while the symbol blocks are moving, it can even be said that interest in the game results by a player can be sustained until the symbol blocks are finally disposed because the disposed positions of the symbol blocks or the game results are difficult to predict.

It should be noted that the function of the control unit 50 in the gaming machine 1 described above may even be achieved via the execution of a program by a computer. That is, development of one or a plurality of computers wherein a program that functions similar to the control unit 50 described above is possible. A function achieved by executing such a program is similar to the control unit 50 described above, that is, a function for rotating the reels (1) to (5) according to the operation of the operation unit by a player, a function for stopping the rotation of the reels (1) to (5) and for forming a symbol sequence in the symbol display region 60, and when a predetermined game condition is satisfied, a function for displaying at least one symbol block in the block display region 66, a function for facing a symbol block displayed in the block display region 66 towards the symbol display region 60, moving the symbol block in a direction intersecting the rotation direction of the reels, and disposing the symbol block in a position overlapping with a symbol sequence in which a symbol block is formed within the symbol display region 60, a function for superimposing and displaying the symbol of a symbol block in the position of a symbol sequence overlapping a symbol block, and a function for granting an award for a symbol sequence in the symbol display region 60 superimposed and displayed by a symbol in a symbol block are achieved.

The program described above, for example, can be provided recorded on a recording medium readable by a computer such as a ROM or a semiconductor memory.

As described above, a gaming machine according to the first embodiment of the present invention including an operation unit that accepts operation by a player, a display unit having a first region that partially displays a plurality of reels each having a series of symbols and a second region that aligns with a first region in the rotational direction of a reel, and a control unit connected to an operation unit and a display unit that rotates and stops a plurality of reels according to the operation of an operation unit by a player, and grants an award for a symbol sequence formed in a first region of a display unit by a stopped plurality of the reels, wherein the control unit displays at least one symbol block configured of one or a plurality of symbols in the second region of the display unit when a predetermined game condition is satisfied, moves a symbol block displayed in the second region to the first region in a direction that intersects the rotational direction of the reels, disposes in a position where a symbol block overlaps with a symbol sequence formed in the first region of the display unit, superimposes and displays a symbol for the symbol block in the position where the symbol block overlaps the symbol sequence, and grants an award for a symbol sequence in the first region of the display unit in which the symbol for the symbol block is superimposed and displayed.

In this type of gaming machine a symbol block displayed in the second region of the display unit moves in a direction intersecting the rotational direction of the reels when moving in the first region of the display unit. That is, the symbol blocks are added to the movement in the direction of reel rotation and also move in a direction orthogonal to the direction of reel rotation. Compared to a case in which a symbol block moves in the direction of reel rotation, prediction by a player of the positions where the symbol blocks are finally disposed is difficult when the symbol blocks move in a direction intersecting the rotational direction of the reels. Therefore, a novel game in which the game progression is varied is achieved according to the gaming machine in the embodiments of the present invention.

Further, a state in which a symbol block is configured by a single type of symbol is also acceptable. In this case, the probability of winning based on a line decision is high in the symbol sequence of a symbol display region after a symbol block is applied because the ratio of the type of symbol configuring a symbol block is high. The probability of winning based on a scatter determination is high when a single type of symbol configuring a symbol block is a scatter symbol.

It should be noted that the type of symbol configuring a symbol block is not limited to a wild symbol, for example each type of symbol illustrated in FIG. 5 (*a*) or the multiplier wild symbols illustrated in FIG. 5 (*b*) are acceptable. Further, as needed, a symbol block may be configured of a plurality of symbol types. Further, a state wherein a plurality of symbol blocks each include a same or a similar type of symbol is also acceptable. For example, a feature function can be provided that achieves a high payout win by configuring a symbol block via the "Pic A" and "Pic B," which are high ranking even within the picture symbols. Further, a case that configures a symbol block of wild symbols mixed with picture symbols is the same.

Further, a state wherein the control unit displays a plurality of symbol blocks in the second region of the display unit and includes the same type of symbol as a symbol block other than one symbol block in the plurality of symbol blocks is also acceptable. In this case, the probability of winning based on a line decision is high in the symbol sequence of a symbol display region after one symbol block and another symbol block are applied because the ratio of the same plurality of symbols increases. The probability of winning based on a scatter determination increases when the same plurality of symbols are scatter symbols.

Further, a state wherein one symbol block and another symbol block within a plurality of symbol blocks composed of different symbols is also acceptable. In FIG. 13, one example of a replacement pattern including a wild symbol "Wild" and a multiplier wild symbol "3×" is illustrated. This replacement pattern is divided into a two row one column "3×" symbol block and a three row three column "Wild" symbol block. A variety of symbol replacement processes are achieved by differing the types of configuring symbols among such a plurality of symbol blocks.

Further, a state wherein the control unit determines a replacement pattern for regulating the region replaced and disposed in the first region of the display unit, and determines the shape of each symbol block by dividing the replacement pattern by a plurality of symbol blocks is also acceptable. In this case, the plurality of symbol blocks wherein a replacement pattern is divided can be moved in various directions. Therefore, the diversification of symbol replacement production can be achieved even in a case where a replacement pattern is used as is in the symbol replacement process with being divided.

Further, a state wherein the control unit can configure a symbol block by each type of size, which is composed of a row m and a column n (m and n are natural numbers) in a symbol, and the control unit divides a replacement pattern so that a symbol block of a largest size is included. The appeal increases when a symbol block moves, and the visual effect of the symbol replacement production improves by the largest symbol block being divided and obtained from such a replacement pattern. Further, when a symbol block is configured of a same type of symbol, the anticipation of a payout for a player is heightened because a winning combination is easily configured and a large payout is easily obtained with a larger symbol block.

Further, a state wherein the symbol block includes a symbol that is used as another symbol when the granting of an award is determined (i.e., a wild symbol) is also acceptable. In this case, when a symbol block is configured of a same type of symbol, the anticipation of a large payout or a bonus award for a player is heightened because a winning combination is easily configured and a winning probability is increased even when a symbol wherein a symbol block is not applied exists.

Further, a state in which the control unit provides a game having a normal game and a special game that is even more advantageous to a player than a normal game, and moves from the normal game to the special game by the predetermined game condition described above is acceptable. Because a winning probability and a large payout are obtained when a symbol replacement process is carried out, a large difference in the winning payout between a special game and normal game can be created by applying a symbol replacement process when a special game such as a feature game or a free game is carried out. As a result, a player will have a strong desire to win a special game, and interest in the game will increase.

The present invention is not limited to the embodiments described above and various modifications are possible. For example, in the embodiments described above, a gaming machine that provides a game via a slot machine is described, but is not limited to this, games of an embodiment such as video card games such as poker, blackjack, and bingo, keno, and wheel games may also be provided. Further, the present invention can also be applied to a pachinko machine or a pachislot machine.

Further, a variety of modifications for operation in each embodiment are possible, for example a state wherein a necessary number of random numbers are acquired in advance and the stopping position for a reel is determined, and the content therein is displayed in order on a display after finishing the determination of special game win and the presence or absence of an award is also acceptable. Further, for example, the control unit 50 acquires a necessary number of random numbers in bulk when a game starts, and stores each random number in a storage region in the memory 53 or the storage 54, which cannot be erased during a power failure. In such a case, even if a power failure occurs in the middle of a game, the control unit 50 can reproduce the progress for a game by acquiring from the memory 53 or the storage 54 the random number acquired when the game started before the power failure. For example, in a case where a power failure occurs right before game results are formed wherein a high payout might be obtained, a player will be highly dissatisfied if the same game progression is not provided after power is restored. However, such dissatisfaction by a player as described above can be avoided by acquiring all random numbers at the start of a game, as described above, and saving these random numbers to the memory 53 or the storage 54 so that a same game progression prior to a power failure can be reproduced after power is restored.

Further, in an embodiment described above, an embodiment is described wherein bills or tickets are described as a game value, these are received by the bill/ticket identification device, and a ticket is output by a printer unit, but the present invention is not limited to these. The game value is a concept including coins, bills, coins, medals, tangible objects such as tickets, or electronic data having an equivalent value. For example, an embodiment wherein a coin is received by a coin acceptor and the coin may be paid from a coin hopper. An embodiment wherein credit accumulated in an account on a server that identifies a player is used, and credit is paid to an account is acceptable, and an embodiment wherein credit information recorded in a storage medium such as a magnetic card or an IC card is read and used, and credit is paid out by writing to the storage medium is also acceptable.

Further, in an embodiment described above, a case that provides a free game as a special game is described, but a normal game may also provide a bonus game using a different virtual reel strip. Further, a feature game provided according to the value of a random number acquired during a normal game can also be provided.

Further, even a predetermined condition providing a special game is not limited to a scatter determination or a line determination, for example when a bet number exceeds a predetermined value, a configuration providing a special game is also acceptable. A configuration that provides a special game according to the value of a random number acquired during a normal game is also possible.

Further, in an embodiment described above, an embodiment that provides a predetermined number of free games as a special game is described, but a special game may be provided without limiting the number of times. In this case, a configuration wherein the combination of specific symbols, establishment of the termination condition of a special game such as the value of a random number acquired during a special game, and the provision of a special game until the termination condition is satisfied is also possible.

Further, in an embodiment described above, an embodiment that triggers the feature function by mystery trigger based on random number is described, but the feature function may be triggered by a combination of specific symbols, a play history of the player, an accumulated game result, a result of sub-game, a result of bonus game or a command from server of casino/slot management system and the like.

1—gaming machine, 21—upper display, 26—lower display, 27—display unit, 44—operation unit, 50—control unit, 51—CPU, 60—symbol display region, 64—cells, 66—block display region, 70—virtual reel set, 71 to 75—virtual reel strips, B1 and B2—symbol blocks.

What is claimed is:

1. A gaming machine, comprising:

an input device including an operation unit that accepts operation by a player;

a display unit configure to display computer generated images associated with a virtual reel game; and a control unit connected to the input device and the display unit for operating the display unit to display the virtual reel game, the control unit including a processor coupled to a memory device, the processor programmed to:

operate the display unit to display a game screen including a first region and a second region, the first region being configured to display a plurality of cells arranged in a matrix, the second region being located above the first region;

generate a plurality of virtual reels including a plurality of symbols and display the virtual reels within the matrix of the first region; and upon receiving a signal from the operation unit indicating the player depressing a spin button of the operation unit:

randomly establish a symbol of the plurality of symbols for each of the cells in the matrix and simulate the virtual reels spinning and stopping to display the symbols within the respective cells to form a first outcome of the virtual reel game; and upon displaying the first arrangement of symbols, perform a set of secondary steps including:

randomly establish a block of replacement display elements, the block of replacement display elements having an established shape with each of the replacement display elements having a replacement symbol;

establish at least two sub-blocks of replacement display elements, the at least two sub-blocks of replacement display elements have respective shapes and being arrangeable to form the established shape of the block of replacement display elements;

operate the display unit to display the at least two sub-blocks of replacement display elements in the second region, the location of the at least two sub-blocks in the second region being determined as a function of a set of predefined rules;

operate the display unit to display the at least two sub-blocks of replacement display elements moving from the second region to the first region in a manner such that the block of replacement display elements is formed by the at least two sub-blocks;

operate the display unit to stop the movement of the least two sub-blocks of replacement display elements such that the block of replacement display elements overlap at least a portion of the matrix of cells displayed in the first region, wherein the replacement symbol within each of the replacement symbol elements is superimposed over a corresponding symbol within a corresponding display element forming a second outcome.

2. The gaming machine, as set forth in claim 1, wherein the secondary steps are performed by the control unit in response to a triggering condition within the first outcome.

3. The gaming machine, as set forth in claim 1, wherein the display unit includes an upper display and a lower display, the processor is programmed to:

operate the lower display to display the first region and operate the upper display to display the second region; and during the secondary steps, operate the display unit to display the at least two sub-blocks of replacement display elements moving from the second region displayed on the upper display to the first region displayed on the lower display.

4. The gaming machine, as set forth in claim 1, wherein the replacement symbol is a wild symbol.

5. The gaming machine, as set forth in claim 1, wherein all of the replacement display elements having an associated replacement symbol displayed therein.

6. The gaming machine, as set forth in claim 5, wherein the replacement symbol in all of the replacement display elements is an identical symbol.

7. The gaming machine, as set forth in claim 5, wherein the replacement symbol in all of the replacement display elements is a wild symbol.

8. The gaming machine, as set forth in claim 1, wherein the block of replacement display elements is randomly chosen from a set of predetermined potential blocks of replacement display elements.

9. The gaming machine, as set forth in claim 1, wherein the block of replacement display elements is dynamically determined.

10. The gaming machine, as set forth in claim 1, wherein the established sub-blocks of replacement display elements are from a set of predetermined sub-blocks of replacement display elements.

11. The gaming machine, as set forth in claim 1, wherein the control unit awards a payout to the player as a function of the first outcome.

12. The gaming machine, as set forth in claim 1, wherein the control unit awards a payout to the player a function of the first outcome and the second outcome.

13. The gaming machine, as set forth in claim 1, wherein the control unit determines the shape of the at least two sub-blocks of replacement display elements by dividing the block of replacement display elements.

14. The gaming machine, as set forth in claim 13, wherein the control unit divides the block of replacement display elements such that one of the at least two sub-groups of replacement display elements includes a block having a maximum size.

15. The gaming machine, as set forth in claim 1, wherein the control unit provides a first game and a second game, the secondary steps being performed in the second game.

16. A method for providing a game in a gaming machine, the gaming machine including an input device including an operation unit, a display unit, and a control unit, the operation unit being configured to accept operation by a player, the display unit configured to display computer generated images associated with a virtual reel game, the control unit connected to the input device and the display unit and including a processor programed to operate the display unit to display the virtual reel game, the method including the control unit performing the steps of:

operating the display unit to display a game screen including a first region and a second region, the first region being configured to display a plurality of cells arranged in a matrix, the second region being located above the first region;

generating a plurality of virtual reels including a plurality of symbols and display the virtual reels within the matrix of the first region; and upon receiving a signal from the operation unit indicating the player depressing a spin button of the operation unit:

randomly establishing a symbol of the plurality of symbols for each of the cells in the matrix and simulate the virtual reels spinning and stopping to display the symbols within the respective cells to form a first outcome of the virtual reel game; and upon displaying the first arrangement of symbols, performing a set of secondary steps including:

randomly establishing a block of replacement display elements, the block of replacement display elements having an established shape with each of the replacement display elements having a replacement symbol;

establishing at least two sub-blocks of replacement display elements, the at least two sub-blocks of replacement display elements have respective shapes and being arrangeable to form the established shape of the block of replacement display elements;

operating the display unit to display the at least two sub-blocks of replacement display elements in the second region, the location of the at least two sub-blocks in the second region being determined as a function of a set of predefined rules;

operating the display unit to display the at least two sub-blocks of replacement display elements moving from the second region to the first region in a manner such that the block of replacement display elements is formed by the at least two sub-blocks;

operating the display unit to stop the movement of the least two sub-blocks of replacement display elements such that the block of replacement display elements overlap at least a portion of the matrix of cells displayed in the first region, wherein the replacement symbol within each of the replacement symbol elements is superimposed over a corresponding symbol within a corresponding display element forming a second outcome.

17. The method, as set forth in claim 16, wherein the secondary steps are performed by the in response to a triggering condition within the first outcome.

18. The method, as set forth in claim 16, wherein the display unit includes an upper display and a lower display, the control unit perform the steps including:

operating the lower display to display the first region and operate the upper display to display the second region; and during the secondary steps, operating the display unit to display the at least two sub-blocks of replacement display elements moving from the second region displayed on the upper display to the first region displayed on the lower display.

19. The method, as set forth in claim 16, wherein the replacement symbol is a wild symbol.

20. The method, as set forth in claim 16, wherein all of the replacement display elements having an associated replacement symbol displayed therein.

21. The method, as set forth in claim 20, wherein the replacement symbol in all of the replacement display elements is an identical symbol.

22. The method, as set forth in claim 20, wherein the replacement symbol in all of the replacement display elements is a wild symbol.

23. The method, as set forth in claim 16, wherein the block of replacement display elements is randomly chosen from a set of predetermined potential blocks of replacement display elements.

24. The method, as set forth in claim 16, wherein the block of replacement display elements is dynamically determined.

25. The method, as set forth in claim 16, wherein the established sub-blocks of replacement display elements are from a set of predetermined sub-blocks of replacement display elements.

26. The method, as set forth in claim 16, including the step of awarding a payout to the player as a function of the first outcome.

27. The method, as set forth in claim 16, including the step of awarding a payout to the player a function of the first outcome and the second outcome.

28. The method, as set forth in claim 16, wherein the shape of the at least two sub-blocks of replacement display elements is determined by dividing the block of replacement display elements.

29. The method, as set forth in claim 28, wherein the block of replacement display elements is divided such that one of the at least two sub-groups of replacement display elements includes a block having a maximum size.

30. The method, as set forth in claim 16, wherein the gaming machine providing provides a first game and a second game, the secondary steps being performed in the second game.

31. A non-transitory computer-readable storage media, having a program including computer-executable instructions for operating a gaming machine embodied thereon, the gaming machine including an input device including an operation unit, a display unit, and a control unit, the operation unit being configured to accept operation by a player, the display unit configured to display computer generated images associated with a virtual reel game, the control unit connected to the input device and the display unit and including a processor programed to operate the display unit to display the virtual reel game, wherein when executed by at least one processor of the gaming machine, the computer-executable instructions cause the gaming machine to perform the steps of:

operating the display unit to display a game screen including a first region and a second region, the first region being configured to display a plurality of cells arranged in a matrix, the second region being located above the first region;

generating a plurality of virtual reels including a plurality of symbols and display the virtual reels within the matrix of the first region; and upon receiving a signal from the operation unit indicating the player depressing a spin button of the operation unit:

randomly establishing a symbol of the plurality of symbols for each of the cells in the matrix and simulate the virtual reels spinning and stopping to display the symbols within the respective cells to form a first outcome of the virtual reel game; and upon displaying the first arrangement of symbols, performing a set of secondary steps including:

randomly establishing a block of replacement display elements, the block of replacement display elements having an established shape with each of the replacement display elements having a replacement symbol;

establishing at least two sub-blocks of replacement display elements, the at least two sub-blocks of replacement display elements have respective shapes and being arrangeable to form the established shape of the block of replacement display elements;

operating the display unit to display the at least two sub-blocks of replacement display elements in the second region, the location of the at least two sub-blocks in the second region being determined as a function of a set of predefined rules;

operating the display unit to display the at least two sub-blocks of replacement display elements moving from the second region to the first region in a manner such that the block of replacement display elements is formed by the at least two sub-blocks;

operating the display unit to stop the movement of the least two sub-blocks of replacement display elements such that the block of replacement display elements overlap at least a portion of the matrix of cells displayed in the first region, wherein the replacement symbol within each of the replacement symbol elements is superimposed over a corresponding symbol within a corresponding display element forming a second outcome.

* * * * *